United States Patent [19]

Shibata

[11] Patent Number: 5,036,804

[45] Date of Patent: Aug. 6, 1991

[54] COOLING SYSTEM FOR FOUR STROKE OUTBOARD MOTOR

[75] Inventor: Yasuhiko Shibata, Shizuoka, Japan

[73] Assignee: Sanshin Kogyo Kabushiki Kaisha, Hamamatsu, Japan

[21] Appl. No.: 516,079

[22] Filed: Apr. 27, 1990

[30] Foreign Application Priority Data

Apr. 28, 1989 [JP] Japan ..... 1-111850

[51] Int. Cl.[5] ..... F02B 75/18

[52] U.S. Cl. ..... 123/41.74; 440/89; 60/321

[58] Field of Search ..... 123/41.74, 41.75, 41.82 R, 123/195 P, 196 W; 440/88, 89; 60/320, 321

[56] References Cited

U.S. PATENT DOCUMENTS 1,877,051 9/1932 Read ..... 123/41.82

4,377,990 3/1983 Seidl ..... 123/41.74

*Primary Examiner*—Noah P. Kamen

*Attorney, Agent, or Firm*—Ernest A. Beutler

[57] ABSTRACT

A liquid cooling system for a four-cycle internal combustion engine utilized as a power plant for an outboard motor. The cooling system is designed so that coolant is first delivered to cool an exhaust manifold in the cylinder block, then the exhaust ports of the cylinder head and the other cylinder head components and then the cylinder block cooling jacket surrounding the cylinder bores.

8 Claims, 5 Drawing Sheets

COOLING SYSTEM FOR FOUR STROKE OUTBOARD MOTOR

BACKGROUND OF THE INVENTION

This invention relates to a cooling system for a four stroke internal combustion engine and more particularly to an improved liquid cooling system for such engines.

In four cycle engines and particularly those adapted for use in outboard motors, both the cylinder block and cylinder head in which the intake and exhaust ports are formed are provided with respective cooling jackets. Frequently there may be an exhaust manifold or exhaust passage formed in the cylinder block which communicates with the discharge of the exhaust ports of the cylinder heads for discharging the exhaust gases back to the atmosphere through the body of water in which the watercraft is operated. The cylinder block exhaust passage is also normally water cooled.

In connection with such engines, it has been the normal practice to circulate the cooling water first through the cylinder block around its cylinder liners and around the exhaust manifold in the cylinder block. The coolant is then delivered from the cylinder block cooling jacket to the cylinder head cooling jacket for cooling the cylinder head and the exhaust ports formed therein. This means that by the time the cooling water has reached the exhaust ports it has been quite heated. Obviously, the efficiency of the cooling system depends upon the difference in temperature between the coolant and the portion of the engine being cooled. As a result, the cooling of the exhaust gases is basically inefficient and hot spots in the cylinder head can result.

It is, therefore, a principal object of this invention to provide an improved cooling system for an internal combustion engine.

It is a further object of this invention to provide an improved cooling system for a four cycle internal combustion engine employed in an outboard motor.

It is a further object of this invention to provide an improved liquid cooling system for a four cycle engine in which the cooling of the cylinder head exhaust ports is promoted.

SUMMARY OF THE INVENTION

This invention is adapted to be embodied in a cooling system for a four cycle internal combustion engine having a cylinder block in which at least one cylinder bore is formed. A cylinder head closes the cylinder block and is formed within an exhaust port for discharge of exhaust gases from the cylinder bore. A cooling jacket is formed in the cylinder block for cooling the cylinder bore. A cooling jacket is formed in the cylinder head for cooling the exhaust port and means are provided for introducing cooling water first to the cylinder head cooling jacket and from the cylinder head cooling jacket to the cylinder block cooling jacket.

DETAILED DESCRIPTION OF THE PREFERRED EMBODIMENT OF THE INVENTION

Figure 1:
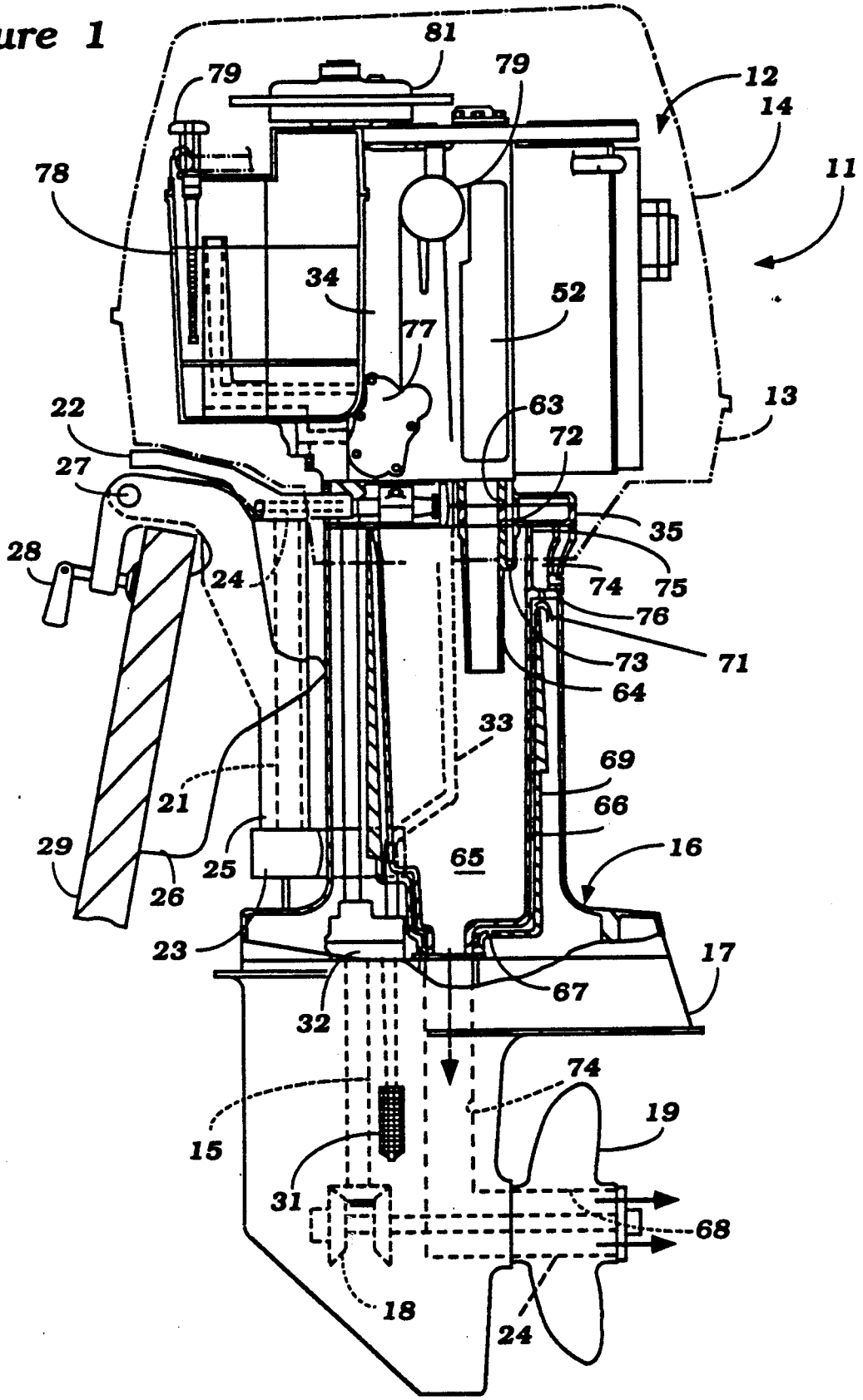
FIG. 1 is a side elevational view of an outboard motor as attached to the transom of a watercraft with portions broken away and other portions shown in phantom.
Figure 2:
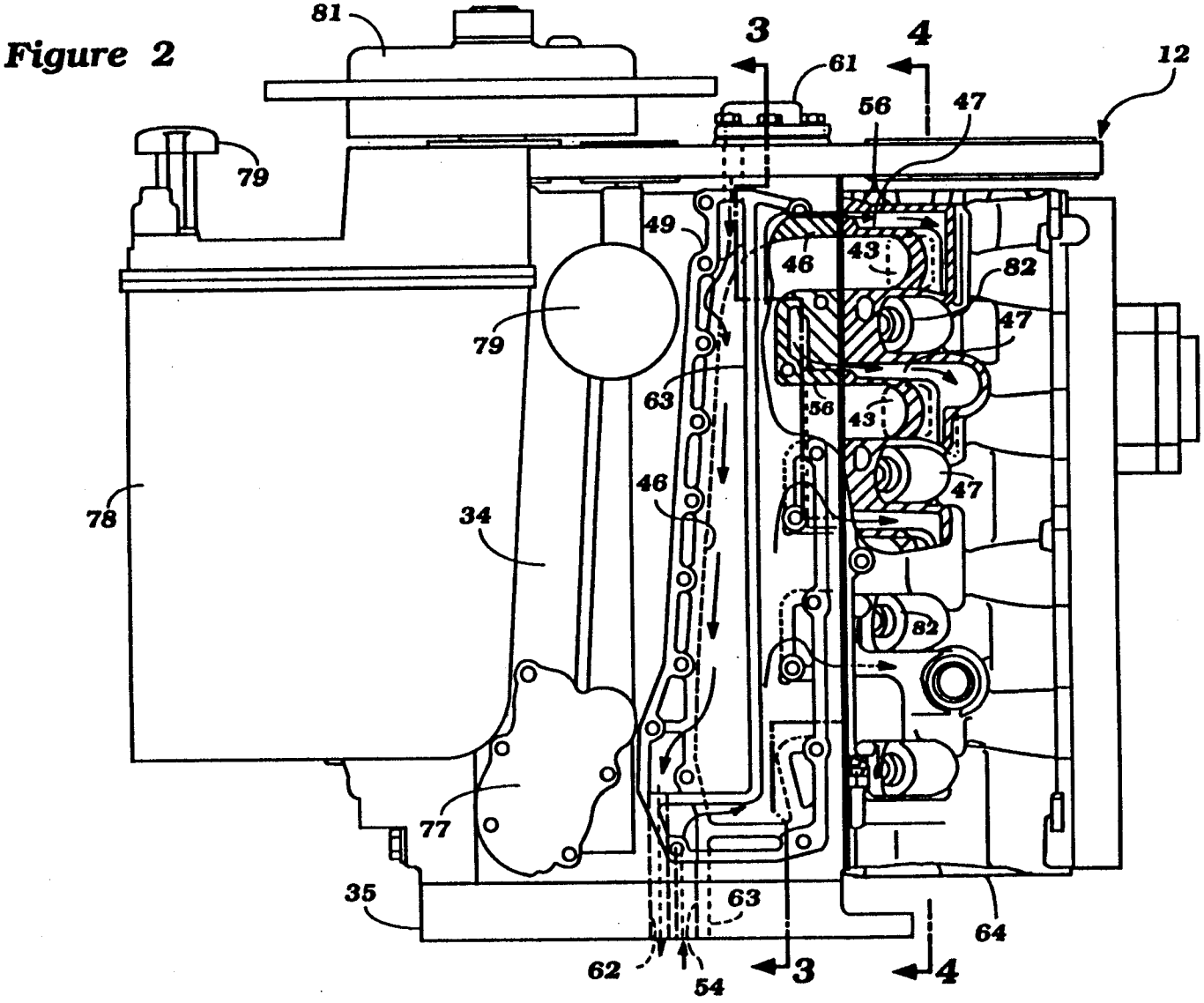
FIG. 2 is an enlarged side elevational view of the engine with portions broken away.
Figure 3:
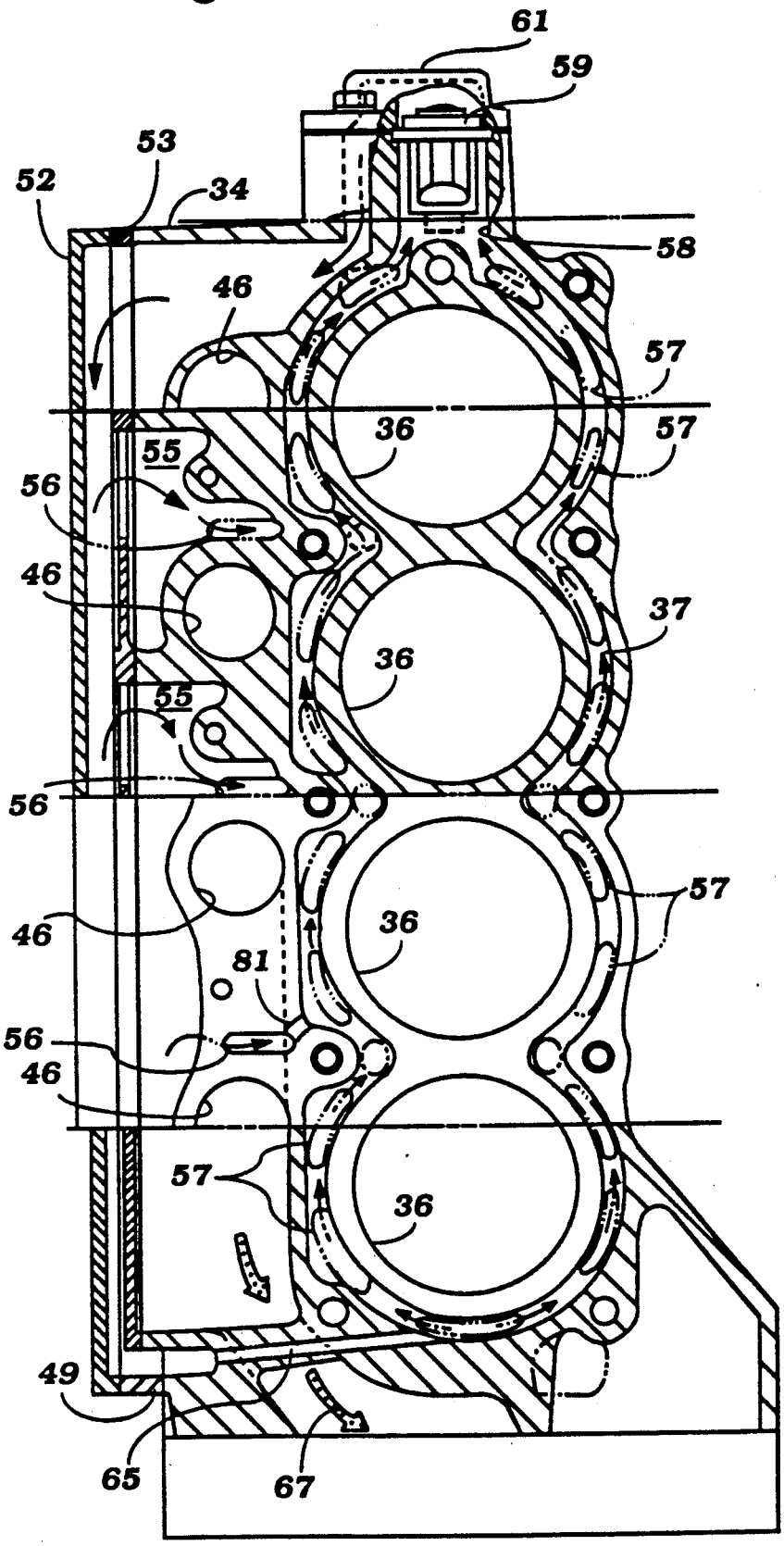
FIG. 3 is an enlarged cross sectional view taken along the line 3—3 of FIG. 2.
Figure 4:
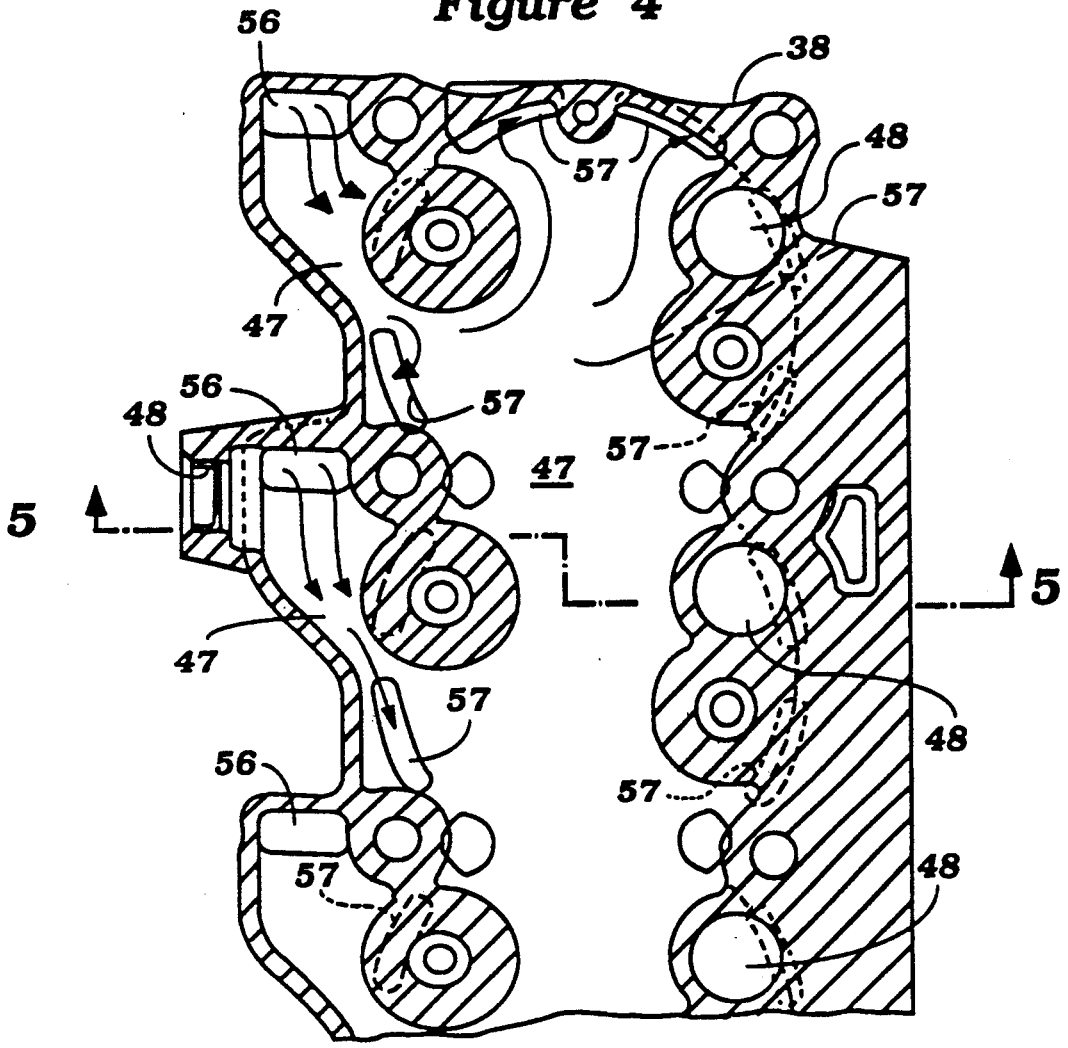
FIG. 4 is a partial cross sectional view taken generally along the line 4—4 of FIG. 2 and is on an enlarged scale.
Figure 5:
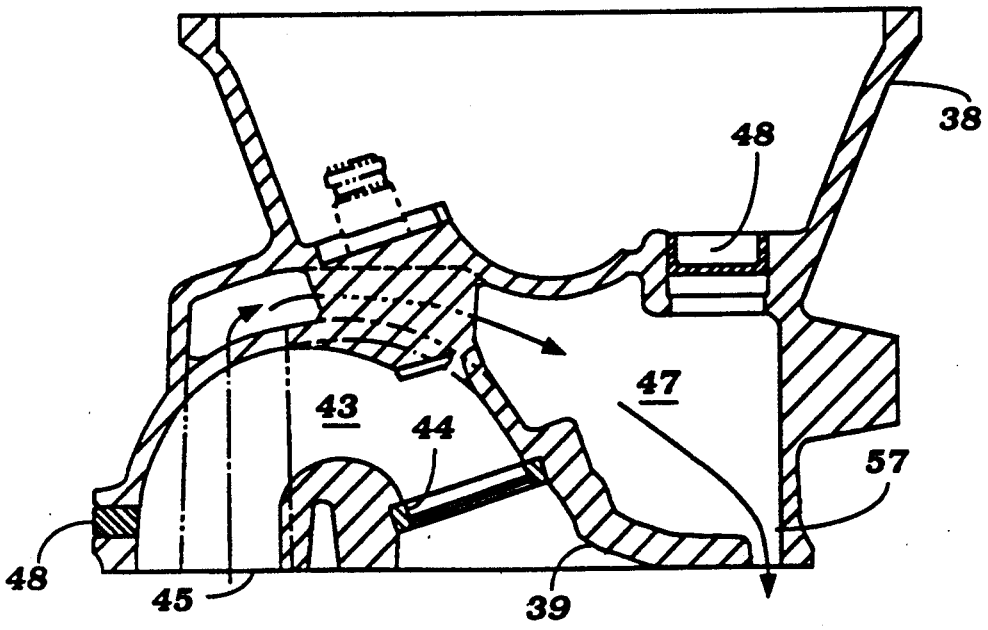
FIG. 5 is a cross sectional view taken along the line 5—5 of FIG. 4.

Referring now in detail to the drawings and initially primarily to FIG, an outboard motor constructed in accordance with an embodiment of the invention and specifically propelled by a liquid cooled, four-cycle internal combustion engine having a liquid cooling system constructed in accordance with an embodiment of the invention is identified generally by the reference numeral 11. Although the invention is described in conjunction with an outboard motor, it can be utilized with other engine applications. However, the invention has particular utility in conjunction with outboard motors because of the particular exhaust gas circuitry used within the cylinder head and cylinder block of such outboard motors.

The outboard motor 11 is comprised of a power head having an internal combustion engine 12, which as has been noted, is of the four-cycle water cooled type. In the specific embodiment, the engine 12 is of the four cylinder in line type although the invention has utility in conjunction with other numbers of cylinders and other cylinder arrangement. The power head of the outboard motor 11 is completed by a protective cowling shown in phantom in this figure and comprised of a lower tray portion 13 and an upper or main cowling portion !4. The engine crankshaft is coupled to a drive shaft 15 which depends into and is journalled within a drive shaft housing, indicated generally by the reference numeral 16. This drive shaft housing 16 has connected to its lower end a lower unit 17. The drive shaft 15 depends into the lower unit 17 and there forms a portion of a conventional forward, neutral, reverse transmission 18 for selectively driving a propeller 19 in forward or reverse directions.

A steering shaft 21 having a tiller 22 affixed to its upper end is fixed in a suitable manner, as by means by a mounting member 23 and fastener assembly 24 to the drive shaft housing 16. This steering shaft 21 is journalled for steering movement of the outboard motor 11 within a swivel bracket 25. The swivel bracket 25 is, in turn, connected to a clamping bracket 26 for pivotal movement about a horizontally extending pivot axis by a pivot pin 27. A clamping device 28 is carried by the clamping bracket 26 for affixing the outboard motor 11 to a transom 29 of an associated watercraft in a known manner. As thus far described, the construction of the outboard motor 11 may be considered to be convention and since the invention relates primarily to the cooling system for the engine 12 other details of the construction of the outboard motor which are conventional will not be described.

The engine cooling system includes a water inlet 31 that is formed in the lower unit 17 at a point below the water line under all running conditions and through which water is drawn from the body of water in which the water craft is operating. A coolant pump 32 is mounted at the interface between the drive shaft housing 16 and the lower unit 17 and is driven by the drive shaft 15 in a known manner. This coolant is then delivered upwardly to the engine 12 through a conduit 33 that extends from the pump 32 and through the drive shaft housing 16.

Referring now in detail to FIGS. 2 through 5, the engine 12 is comprised of a cylinder block 34 that is mounted on a spacer plate 35 which is, in turn, affixed to the upper end of the drive shaft housing 16. The cylinder block 34, as is conventional with outboard motor practice, has cylinder bores 36 that extend along horizontally extending planes so that the associated crankshaft (not shown) will rotate about a vertically extending axis to facilitate its coupling to the drive shaft 15 as aforenoted. The cylinder block 34 is provided with a cooling jacket 37 that extends around the outer periphery of the cylinder bores 36. The portion of the cylinder block forming the cylinder bores 36 may be siamesed between adjacent cylinder bores so that the cooling jacket 37 extends generally around only the sides of the cylinder bores 36 and not the area between them. Such a cooling system is adequate.

Figure 6:
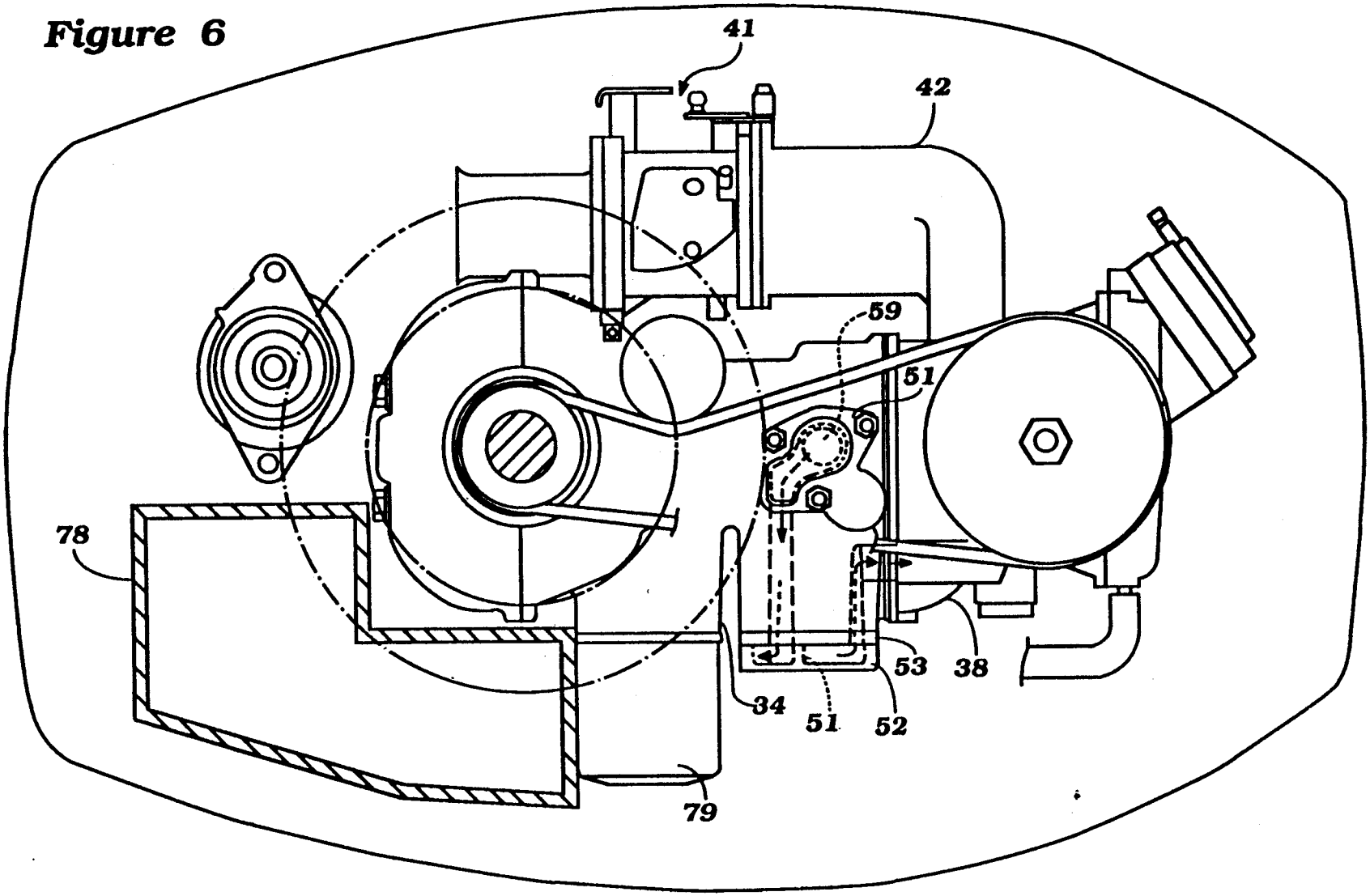
FIG. 6 is a top plan view of the outboard motor with the protective cowling upper portion removed and with a portion shown in section.

A cylinder head 38 is affixed to the cylinder block 34 in a known manner and is provided with combustion chamber recesses 39 (FIG. 5) that extend over enclosed the cylinder bores 36 and which form the combustion chambers of the engine. An induction and exhaust system is provided for admitting an intake charge to the combustion chambers 39 and discharging the exhaust burnt exhaust gases from it. The induction system includes one or more carburetors 41 (FIG. 6) that deliver air to an inlet side of the cylinder head 38 through an intake manifold 42. The induction system is not shown in the drawings since the specific induction system employed forms no part of the invention.

There are provided a plurality of generally U-shaped exhaust passages 43 that extend from valve seats 44 adjacent the combustion chamber recesses 39 through a lower face 45 of the cylinder head 38 wherein they communicate with an exhaust collectors section and exhaust manifold 46 formed in the cylinder block 34. Exhaust valves cooperate with the valve seats for controlling the flow of exhaust gases through the exhaust system, as is well known in this art.

The cylinder head 38 is formed with a main cooling jacket 47 that surrounds the combustion chamber recesses 39 and also which has portions that encircle the exhaust ports 43. A plurality of clean out plugs 48 are pressed into openings in the cylinder head 38. These openings are employed to remove sand of the core from the casting which forms the cooling jacket 47.

The exhaust side of the cylinder block 34 is provided with a water manifold that is formed by an outer wall 49 that is divided into an inlet section and an outlet section by an internal wall 51. A cover plate 52 encloses this water manifold and a sealing gasket 53 is interposed between the cover plate 52 and the cylinder block 34 for sealing purposes.

A water inlet passageway 54 is formed in the spacer plate 35 and communicates at its lower end with the delivery conduit 33 for the water. The cooling water then flows from the spacer plate passageway 54 to the inlet portion of the water manifold thus far described and then flows into cooling jacket portions of the cylinder block 34 which surround the exhaust manifold 46, which portions are identified by the reference numeral 55. It should be noted that the portions are spaced from the cylinder block cooling jacket 37 and thus serve to cool only the exhaust manifold 46. The direction of flow appears in the arrows in the figures.

A plurality of delivery ports 56 are formed in the top deck of the cylinder block 34 and communicate with like ports 56 formed in the lower face 45 of the cylinder head 38. These delivery passages 56 are in proximity to the exhaust ports 43 and hence cooling water will be first delivered from the manifold 55 to the cylinder head cooling jacket 47 in proximity to the exhaust passages so that they will be cooled by water that has had very little temperature elevation. The water will then flow to the remainder of the cylinder head cooling 47 so as to cool it and the combustion chamber recesses 39.

The cooling water is then delivered downwardly through a plurality of arcuate shaped delivery ports 57 formed in the lower face 45 of the cylinder head 38 to the cylinder block cooling jacket 37. If a closed deck configuration is employed for the cylinder block, corresponding delivery ports 57 will be formed in the this closed deck for the flow as shown in the figures.

The upper end of the cylinder block cooling jacket 37 is provided with a discharge port 58 in which a thermostatic valve 59 is provided. This thermostatic valve 59 is enclosed and held in place by a cover plate 61 that is affixed to the cylinder block 34 in a known manner. When the engine reaches its operating temperature, the thermostatic valve 59 will open and permit water to flow through a return passageway formed in the cylinder block 34 by the upstanding wall 49 and dividing wall 51 previously referred to and by the cover plate 52. This water is then discharged down into the drive shaft housing 16 through a discharge port 62 formed in the spacer plate 35.

The spacer plate 35 is provided with an exhaust port 63 that communicates with the lower end of the exhaust manifold 46 and which delivers exhaust gases to a relatively short length exhaust pipe 64 which depends into the drive shaft housing 16. The end of the exhaust pipe 64 communicates with the expansion chamber 65 formed within the drive shaft housing 16 by means including a baffle member 66. A seal 67 at the lower end of the expansion chamber 65 permits the exhaust gases to flow into a discharge passage 67 formed in the lower unit 17 for discharge through and under the water through the hub exhaust port 68.

A portion of the cooling water from the engine cooling system thus far described is delivered through weep holes to a cooling chamber 69 that extends around the expansion chamber 65 and which overflows at the top through a weir 71 so as to maintain a volume of cooling water around the expansion chamber 65 for cooling and exhaust silencing purposes. The water flowing over the weir 71 is discharged back to the body of water in which the watercraft is operating through a suitable passageway.

In addition, a cooling jacket 72 may encircle a portion of the exhaust pipe 64 and this also receives coolant from the body of water in which the watercraft is operating. A small weep hole 73 formed in the bottom of this cooling jacket permits coolant to flow into the expansion chamber 65 around the outer periphery of the exhaust pipe 64 for cooling and silencing purposes.

The engine further includes an above the water exhaust gas discharge that includes an expansion chamber 74 to which exhaust gases are delivered through a restricted opening 75. These exhaust gases then flow to the atmosphere through the above the water exhaust gas discharge 76. When the watercraft is operating at high speeds, very little exhaust gases will flow out the above the water exhaust gas discharge 76. However, when the engine is operating at low speeds and the through the hub exhaust 68 is deeply submerged, the idle exhaust gases will be silenced and discharged through this above the water exhaust gas system.

The engine 12 is provided with a dry sump lubrication system of the type generally described in my copending application entitled "Lubricating Device For Four-Stroke Outboard Motor", Application Ser. No. 501272 , filed Mar. 29, 1990, and assigned to the Assignee of this application attorney docket number 7118-00376. This dry sump lubricating system includes a dry sump pump assembly 77 comprised of a scavenge pump and lubricant pump which draws lubricant from a dry sump reservoir 78 contained within the power head and delivers it to the engine internals through the lubricant passage system including an oil filter 79. The oil which has then drained from the engine after lubricating is returned by the pump 77 to the reservoir 78. The level in the reservoir 78 can be checked and lubricant added by means of a combined dipstick closure member 79.

The engine is also provided with an ignition system including a flywheel magneto 81 that is affixed to the upper end of the crank shaft of the engine and which fires spark plugs received in spark plug wells 82 (FIG. 2) formed in the cylinder head 38. These spark plug wells 82 are surrounded by the cylinder head cooling jacket 47 for cooling purposes.

It should be readily apparent from the foregoing description that a highly effective cooling system is provided for the engine and one in which the exhaust ports in the cylinder head will be adequately cooled since cooling water is delivered initially to them rather than to the cylinder block cooling jacket. Although an embodiment of the invention has been illustrated and described, various changes and modifications may be made without departing from the spirit and scope of the invention, as defined by the appended claims.

I claim:

1. A cooling system for a four-cycle internal combustion engine having a cylinder block in which at least one cylinder bore is formed, a cylinder head closing said cylinder block and formed with an exhaust passage for discharge of exhaust gases from said cylinder bore, said exhaust passages through a lower face of said cylinder head and communicating with an exhaust manifold formed in said cylinder block, a cooling jacket in said cylinder block for cooling said cylinder bore, a cooling jacket in said cylinder head for cooling said exhaust passage, and means for introducing coolant first to said cylinder head cooling jacket and from said cylinder head cooling jacket to said cylinder block cooling jacket.

2. A cooling system for a four-cycle internal combustion engine as recited in claim 1, wherein the cylinder head cooling jacket includes a portion surrounding the combustion chamber and cooling it and another portion surrounding the exhaust passage.

3. A cooling system for a four-cycle internal combustion engine as recited in claim 2, wherein the coolant is delivered first to the portion of the cylinder head cooling jacket surrounding the exhaust passage.

4. A cooling system for a four-cycle internal combustion engine as recited in claim 3, wherein coolant is delivered from the cylinder head cooling jacket to the cylinder block cooling jacket through a plurality of delivery passages extending around the cylinder bore.

5. A cooling system for a four-cycle internal combustion engine as recited in claim 1, wherein the coolant is first delivered to a cooling jacket extending along a side of the cylinder block exhaust manifold and then to the cylinder head cooling jacket.

6. A cooling system for a four-cycle internal combustion engine as recited in claim 5, wherein the cylinder head cooling jacket includes a portion surrounding the combustion chamber and cooling it and another portion surrounding the exhaust passage.

7. A cooling system for a four-cycle internal combustion engine as recited in claim 6, wherein the coolant is delivered first to the portion of the cylinder head cooling jacket surrounding the exhaust passage.

8. A cooling system for a four-cycle internal combustion engine as recited in claim 7, wherein coolant is delivered from the cylinder head cooling jacket to the cylinder block cooling jacket through a plurality of delivery passages extending around the cylinder bore.

* * * * *

UNITED STATES PATENT AND TRADEMARK OFFICE

CERTIFICATE OF CORRECTION

PATENT NO. : 5,036,804

DATED : August 6, 1991

INVENTOR(S) : Yasuhiko Shibata

It is certified that error appears in the above-identified patent and that said Letters Patent is hereby corrected as shown below:

Column 6, line 3, Claim 1, "passages" should be --passage passing--.

Signed and Sealed this

Twenty-first Day of September, 1993

Bruce Lehman

*Attest:*

BRUCE LEHMAN

*Attesting Officer*

*Commissioner of Patents and Trademarks*

US005036804A

REEXAMINATION CERTIFICATE (1921st)

United States Patent [19]

Shibata

[11] B1 5,036,804

[45] Certificate Issued Feb. 2, 1993

[54] COOLING SYSTEM FOR FOUR STROKE OUTBOARD MOTOR

[75] Inventor: Yasuhiko Shibata, Shizuoka, Japan

[73] Assignee: Sanshin Kogyo Kabushiki Kaisha, Hamamatsu, Japan

Reexamination Request:
No. 90/002,662, Mar. 9, 1992

Reexamination Certificate for:

| | |
|---|---|
| Patent No.: | 5,036,804 |
| Issued: | Aug. 6, 1991 |
| Appl. No.: | 516,079 |
| Filed: | Apr. 27, 1990 |

[30] Foreign Application Priority Data

Apr. 28. 1989 [JP] Japan ..... 1-111850

[51] Int. Cl.[5] ..... F02B 75/18

[52] U.S. Cl. ..... 123/41.74; 440/89; 60/321

[58] Field of Search ..... 123/41.74, 41.75, 41.82 R, 123/195 P, 196 W, 41.31; 440/88, 89; 60/320, 321

[56] References Cited

U.S. PATENT DOCUMENTS

| | | | |
|---|---|---|---|
| 1,877,051 | 9/1932 | Read | 123/41.82 |
| 3,358,654 | 12/1967 | Shanahan et al. | 123/41.08 |
| 4,377,990 | 3/1983 | Seidl | 123/41.74 |

FOREIGN PATENT DOCUMENTS 51-56441 10/1974 Japan .

*Primary Examiner*—Noah Kamen

[57] ABSTRACT

A liquid cooling system for a four-cycle internal combustion engine utilized as a power plant for an outboard motor. The cooling system is designed so that coolant is first delivered to cool an exhaust manifold in the cylinder block, then the exhaust ports of the cylinder head and the other cylinder head components and then the cylinder block cooling jacket surrounding the cylinder bores.

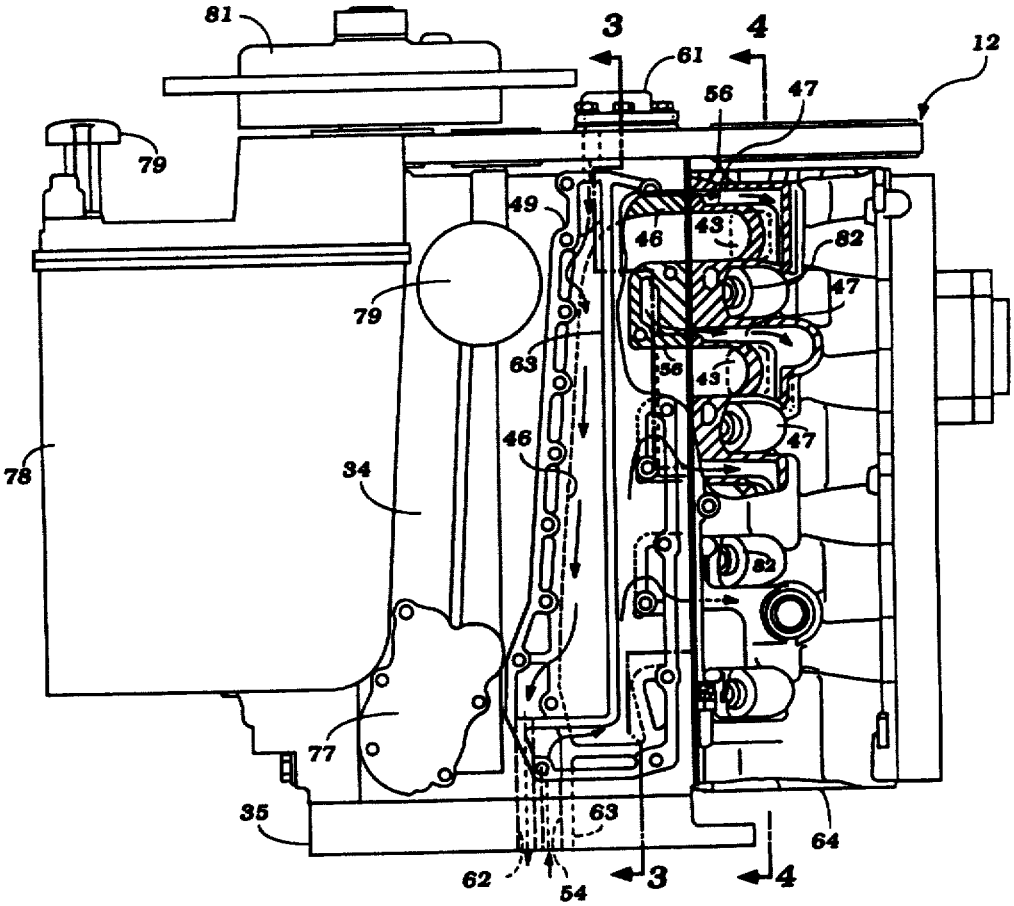

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3-5, 7 and 8 are determined to be patentable as amended.

Claims 2 and 6, dependent on an amended claim, are determined to be patentable.

New claims 9-24 are added and determined to be patentable.

1. A cooling system for a four-cycle internal combustion engine having a cylinder block in which at least one cylinder bore is formed, a cylinder head closing said cylinder block and formed with an exhaust passage for discharge of exhaust gases from said cylinder bore, said exhaust [passages] *passage passing* through a lower face of said cylinder head and communicating with an exhaust manifold formed *integrally* in said cylinder block, a cooling jacket in said cylinder block for cooling said cylinder bore, a cooling jacket in said cylinder head for cooling said exhaust passage, and means for introducing coolant first to said cylinder head cooling jacket and from said cylinder head cooling jacket to said cylinder block cooling jacket.

3. A cooling system for a four-cycle internal combustion engine as recited in claim 2, wherein the coolant is delivered first to the portion of the cylinder head cooling jacket surrounding the exhaust passage *and then to the other portion of the cylinder head cooling jacket.*

4. A cooling system for a four-cycle internal combustion engine as recited in claim 3, wherein coolant is delivered from the *other portion of the* cylinder head cooling jacket to the cylinder block cooling jacket through a plurality of delivery passages extending around the cylinder bore.

5. A cooling system for a four-cycle internal combustion engine as recited in claim 1, wherein the coolant is first delivered to [a] *an exhaust manifold* cooling jacket extending along a side of the cylinder block exhaust manifold and then to the cylinder head cooling jacket *and then back to the cylinder block cooling jacket.*

7. A cooling system for a four-cycle internal combustion engine as recited in claim 6, wherein the coolant is delivered first to the portion of the cylinder head cooling jacket surrounding the exhaust passage *and then to the other portion of the cylinder head cool jacket.*

8. A cooling system for a four-cycle internal combustion engine as recited in claim 7, wherein coolant is delivered from the *other portion of the* cylinder head cooling jacket to the cylinder block cooling jacket through a plurality of delivery passages extending around the cylinder bore.

*9. A cooling system as for a four-cycle internal combustion engine as recited in claim 1 wherein the cylinder block is formed with a plurality of cylinder bores and the cylinder head has a plurality of exhaust passages each extending through a separate outlet opening formed in the lower face of said cylinder head, said cylinder block being formed with a plurality of exhaust inlet openings formed integrally in an upper surface thereof and communicating with an exhaust manifold formed integrally in said block below said upper surface and extending terminating short of the ends of said cylinder block, and an exhaust discharge formed in one end of said cylinder block and communicating with said exhaust manifold for discharge of exhaust gases from said cylinder block, said cylinder head and cylinder block being substantially coextensive in length from one end thereof to the other.*

*10. A cooling system for a four-cycle internal combustion engine as recited in claim 1, wherein the cylinder head cooling jacket includes a portion surrounding the combustion chambers and cooling them and another portion surrounding the exhaust passages.*

*11. A cooling system for a four-cycle internal combustion engine as recited in claim 10, wherein the coolant is delivered first to the portion of the cylinder head cooling jacket surrounding the exhaust passages and then to the other portion of the cylinder head cooling jacket.*

*12. A cooling system for a four-cycle internal combustion engines as recited in claim 11, wherein coolant is delivered from the other portion of the cylinder head cooling jacket to the cylinder block cooling jacket through a plurality of delivery passages extending around the cylinder bores.*

*13. A cooling system for a four-cycle internal combustion engine as recited in claim 9, wherein the coolant is first delivered to an exhaust manifold cooling jacket extending along a side of the cylinder block exhaust manifold and then to the cylinder head cooling jacket and then back to the cylinder block cooling jacket.*

*14. A cooling system for a four-cycle internal combustion engine as recited in claim 13, wherein the cylinder head cooling jacket includes a portion surrounding the combustion chambers and cooling then and another portion surrounding the exhaust passage.*

*15. A cooling system for a four-cycle internal combustion engine as recited in claim 14, wherein the coolant is delivered first to the portion of the cylinder head cooling jacket surrounding the exhaust passages and then to the other portion of the cylinder head cooling jacket.*

*16. A cooling system for a four-cycle internal combustion engine as recited in claim 11, wherein coolant is delivered from the other portion of the cylinder head cooling jacket to the cylinder block cooling jacket through a plurality of delivery passages extending around the cylinder bores.*

*17. A cooling system for a four-cycle internal combustion engines as set forth on claim 9 in combination with an outboard motor wherein the cylinders positioned one above the other in a vertical direction and having a drive shaft housing depending from said power head and receiving the exhaust gases from said cylinder block exhaust outlet.*

*18. A cooling system for a four-cycle internal combustion engine as recited in claim 17, wherein the cylinder head cooling jacket includes a portion surrounding the combustion chambers and cooling them and another portion surrounding the exhaust passages.*

*19. A cooling system for a four-cycle internal combustion engine as recited in claim 18, wherein the coolant is delivered first to the portion of the cylinder head cooling jacket surrounding the exhaust passages and then to the other portion of the cylinder head cooling jacket.*

*20. A cooling system for a four-cycle internal combustion engines as recited in claim 19, wherein coolant is delivered from the other portion of the cylinder head cooling jacket to the cylinder block cooling jacket through a plurality of delivery passages extending around the cylinder bores.*

*21. A cooling system for a four-cycle internal combustion engine as recited in claim 9, wherein the coolant is first delivered to an exhaust manifold cooling jacket extending along a side of the cylinder block exhaust manifold and then to the cylinder head cooling jacket and then back to the cylinder block cooling jacket.*

*22. A cooling system for a four-cycle internal combustion engine as recited in claim 21, wherein the cylinder head cooling jacket includes a portion surrounding the combustion chambers and cooling them and another portion surrounding the exhaust passages.*

*23. A cooling system for a four-cycle internal combustion engine as recited in claim 22, wherein the coolant is delivered first to the portion of the cylinder head cooling jacket surrounding the exhaust passages and then to the other portion of the cylinder head cooling jacket.*

*24. A cooling system for a four-cycle internal combustion engine as recited in claim 23, wherein coolant is delivered from the other portion of the cylinder head cooling jacket to the cylinder block cooling jacket through a plurality of delivery passages extending around the cylinder bores.*

* * * * *